US005573065A

United States Patent [19]

Sundholm

[11] Patent Number: 5,573,065

[45] Date of Patent: Nov. 12, 1996

[54] SPRAY HEAD PROVIDED WITH A PRESSURE SENSITIVE VALVE

[76] Inventor: Göran Sundholm, Ilmari Kiannon kuja 3, FIN-04310 Tuusula, Finland

[21] Appl. No.: 307,827

[22] PCT Filed: Jan. 31, 1994

[86] PCT No.: PCT/FI94/00046

§ 371 Date: Nov. 23, 1994

§ 102(e) Date: Nov. 23, 1994

[87] PCT Pub. No.: WO94/16771

PCT Pub. Date: Aug. 4, 1994

[30] Foreign Application Priority Data

Jan. 29, 1993 [FI] Finland ..... 930417

[51] Int. Cl.[6] ..... A62C 37/14

[52] U.S. Cl. ..... 169/37; 169/38; 239/570

[58] Field of Search ..... 169/37, 38, 39, 169/40, 41, 90; 239/570

[56] References Cited

FOREIGN PATENT DOCUMENTS

WO92/22353 12/1992 WIPO .

*Primary Examiner*—Andrew C. Pike

*Attorney, Agent, or Firm*—Ladas & Parry

[57] ABSTRACT

A spray head has a housing, an inlet and nozzles. A release ampoule is mounted in the housing and a spindle element (33) is pressed against the inlet of the spray head by a spring having such a spring force that the spindle element keeps the inlet closed against a stand-by pressure but yields to high pressure extinguishing liquid of a high pressure source for delivering the liquid to the nozzles while the release ampoule remains intact even when a force of the spring acts on the release ampoule.

5 Claims, 5 Drawing Sheets

SPRAY HEAD PROVIDED WITH A PRESSURE SENSITIVE VALVE

The present invention relates to a spray head for a fire fighting installation and, in particular, a fire fighting installation that is capable of operating with a high drive pressure for the extinguishing liquid. A high pressure in this context means a pressure within the range of from about 30 bar to about 300 bar, whereas conventional low pressure installations have an operating pressure of about 5–10 bar. The source for the extinguishing liquid preferably is at least one hydraulic accumulator on an out-going line to a number of automatically releasable spray heads.

It is in many cases desirable, when one spray head has been released directly by a fire, to release a whole group of usually nearby spray heads.

The invention relates to a spray head for this purpose. The spray head comprises a spindle element pressed into an inlet to the spray head with such a spring force that the spindle element keeps the inlet closed against a stand-by or rest pressure of the installation but yields to the pressure of the high pressure liquid source.

The invention shall in the following be described with reference to exemplifying preferred embodiments shown in the attached drawing.

Figure 3:
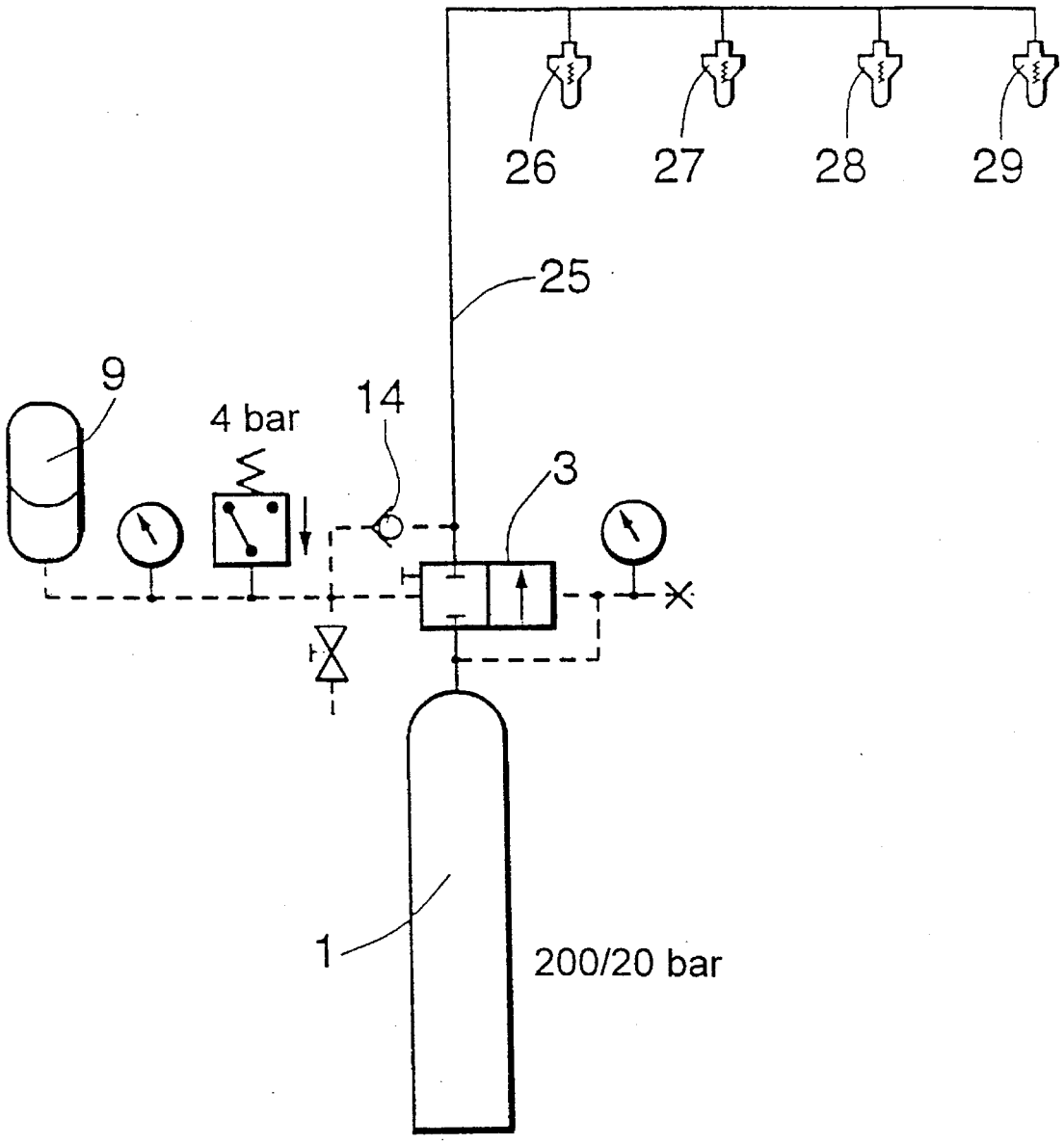
FIG. 3 is a coupling diagram of a fire fighting installation in a stand-by state.

A hydraulic accumulator with a high charge pressure (e.g., 200 bar) is indicated by the reference numeral 1. The accumulator 1, which in the following is also called the primary accumulator, comprises an outlet tube 2, which preferably has a number of apertures in its wall in order to deliver liquid and a mixture of the liquid and a drive gas-of the accumulator as described in Finnish patent application 924752. An outlet valve connected to the tube 2 is generally indicated by 3, the inlet of the valve by 4 and its outlet by 5. The outlet 5 is connected via an out-going line 25 with a number of automatically releasable spray heads 26–29 as shown in FIG. 3.

Figure 1:
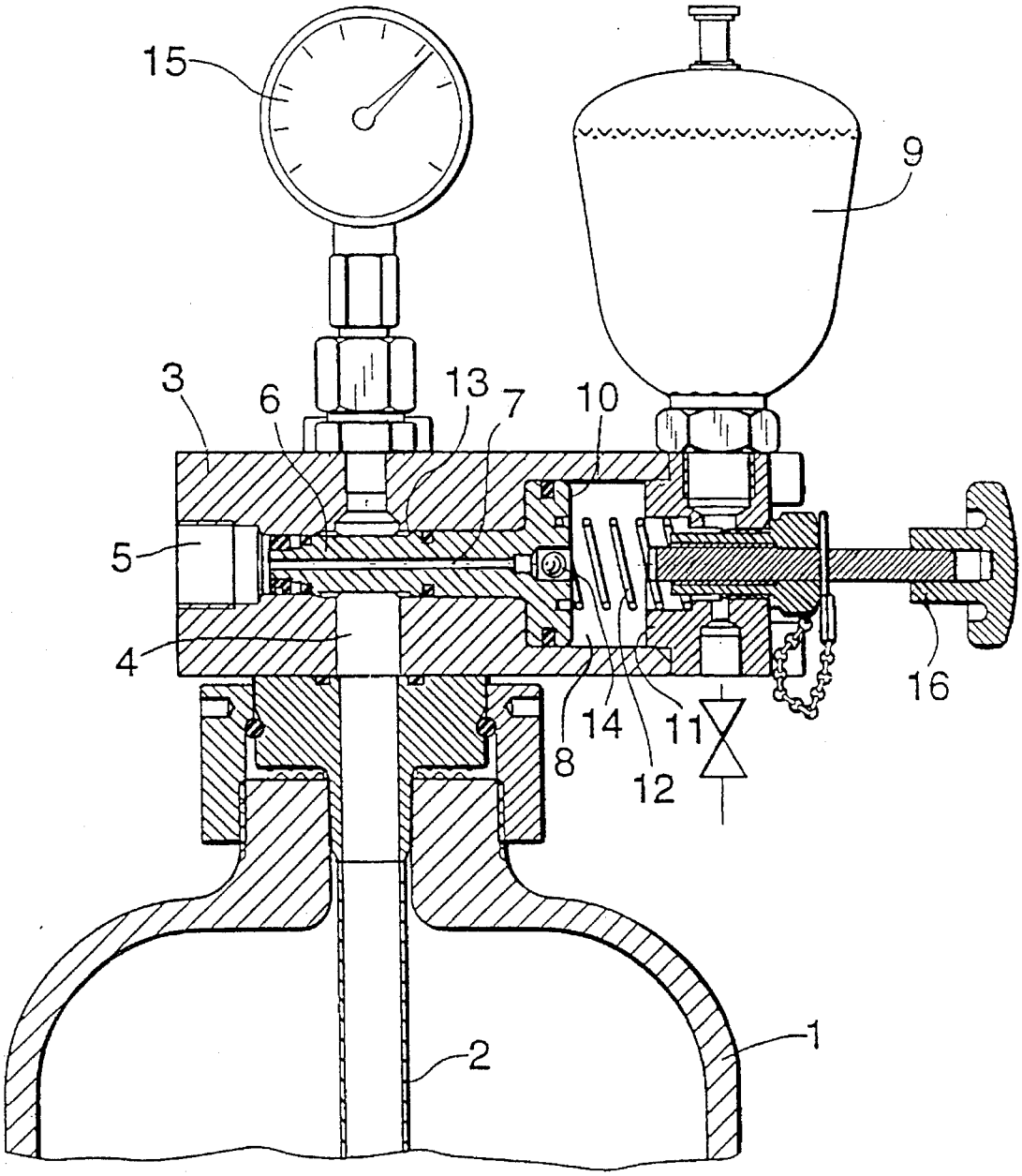
FIG. 1 is an elevational view, partly in cross section, of a valve for a high-drive-pressure fire fighting installation in a stand-by state.

In the stand-by position of the valve 3 shown in FIG. 1, the connection between the inlet 4 and the outlet 5 of the valve is closed by a valve spindle 6. The valve spindle 6 has an axial through channel 7 which connects the outlet 5 to a liquid space 8 which, in turn, is connected to a small (e.g., about 0.3 liter) hydraulic accumulator 9 with a low charge pressure (e.g., 6–10 bar), which in the following is also called the secondary accumulator.

Figure 2:
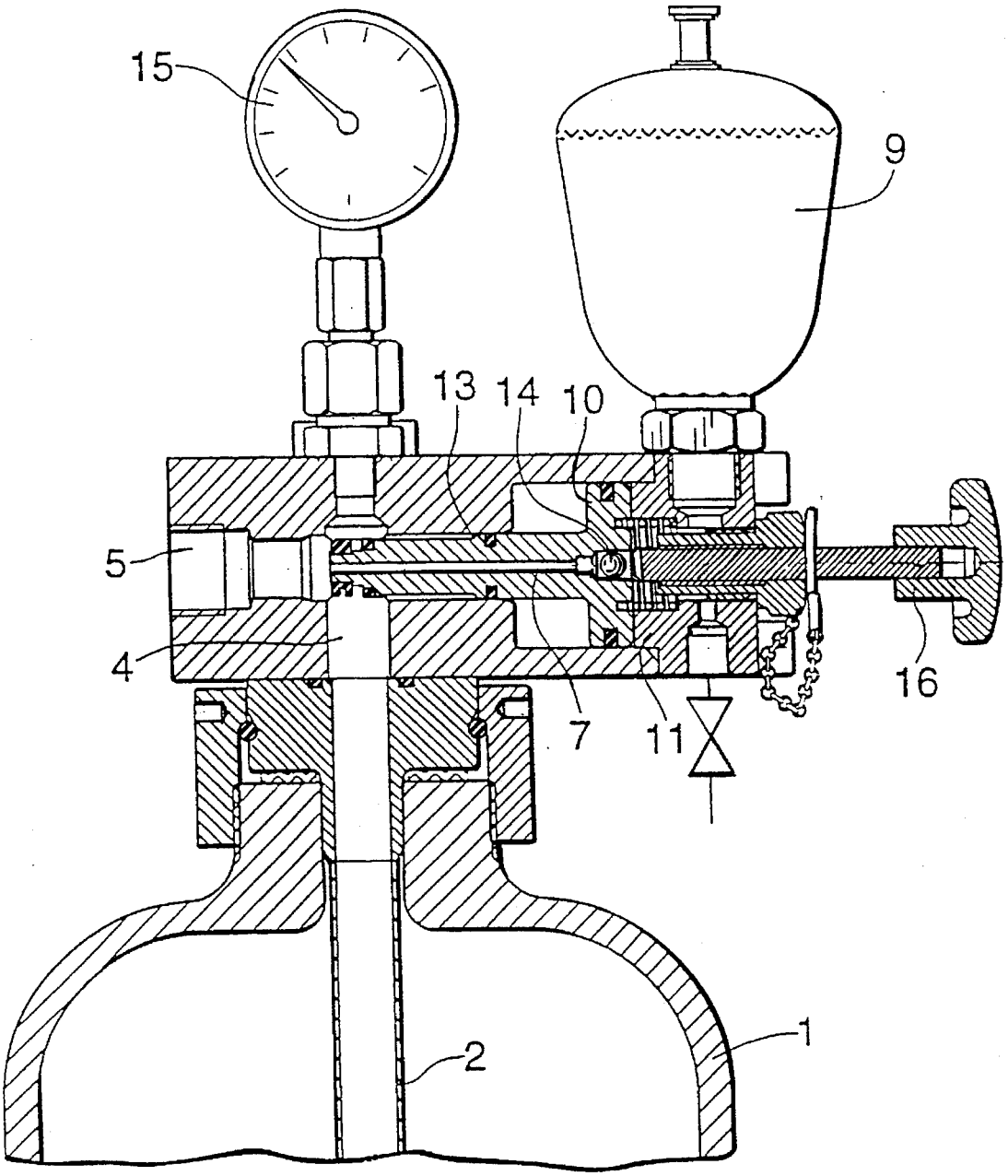
FIG. 2 is an elevational view, partly in cross section, of the valve in an activated state.

The valve spindle 6 has a head 10 which is movable like a piston in the liquid space 8 between the position of FIG. 1, in which the head 10 presses against the valve housing surrounding the spindle 6 and the connection from the inlet 4 to the outlet 5 is closed, and the position of FIG. 2, in which the head 10 presses against a shoulder 11 and the connection from the inlet 4 to the outlet 5 is open.

In the stand-by state of FIG. 1, the spindle 6 is kept in place by the pressure in the liquid space 8, which acts on the spindle head 10, and by a spring 12 pressing on the spindle head 10. The pressure in the inlet 5 on the spindle end therein and the pressure of the primary accumulator on a ring shoulder 13 of the spindle 6 act in the opposite direction.

When a spray head connected to the outlet 5 is released, the secondary accumulator 9 starts delivering liquid to that spray head. As a result, the pressure in the liquid space 8 falls quickly and the pressure of the primary accumulator 1 on the shoulder 13 starts moving the spindle to the right as shown in FIG. 1; and as that end of the spindle 6 which was in the outlet 5 reaches the inlet 4, it also comes under the influence of the pressure of the primary accumulator and the spindle is driven to the end position against the stop 11 as shown in FIG. 2.

The force of the spring 12 is preferably such that it drives the spindle 6 back from the position of FIG. 2 to the position of FIG. 1 after the primary accumulator has been discharged.

A nonreturn valve 14 positioned in the channel 7 of the valve spindle 6 prevents the pressure of the primary accumulator from entering the liquid space 8 when the spindle is in the position of FIG. 2.

A manometer is indicated by 15 and a manually operable reserve release means, which, in FIGS. 1 and 2, is turned off and does not effect the function, as indicated by 16.

It is often of advantage when a fire has broken out and one spray head of a fire fighting installation has been activated to activate also a group of spray heads of the installation even though these still have their release ampoules intact. For the spray heads 26–29 in FIG. 3, one preferable embodiment of spray head for this purpose is shown in FIGS. 4–6.

Figure 4:
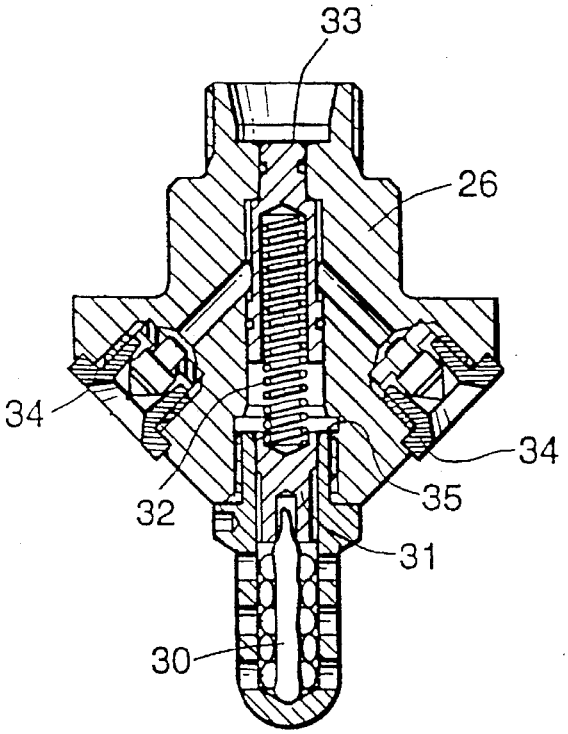
FIG. 4 is a cross-sectional elevational view of a first preferred embodiment of a spray head in the installation of FIG. 3 in a stand-by state.
Figure 5:
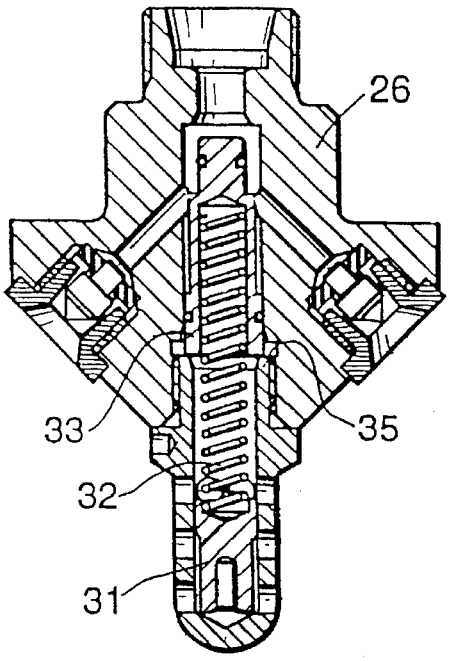
FIG. 5 is a cross-sectional elevational view of the spray head of FIG. 4 in an individually released sate.
Figure 6:
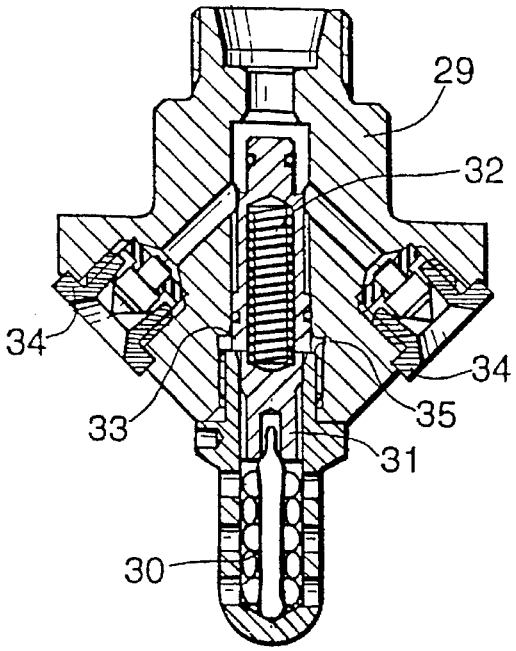
FIG. 6 is a cross-sectional elevational view of another spray head of the installation of FIG. 3 in a group-released state.

The spray head 26, for example, in FIGS. 4 and 5 has a conventional release ampoule 30 engaged by a first spindle element 31, which is pressed by one end of a spring 32 the opposite end of which presses a second spindle element 33 against the inlet opening of the spray head. The force of the spring 32 is such that, without crushing the ampoule 30, it keeps the second spindle element 33 in the inlet of the spray head as shown in FIG. 4 against the full pressure of the second accumulator 9, i.e., when the valve 3 mounted on the primary accumulator 1 is in the state according to FIG. 1. As a result, the spindle element 33 keeps closed a connection of the inlet opening to the nozzles 34 of the spray head.

In FIG. 5, the ampoule 30 of the spray head 26 has been crushed or melted by the influence of a fire nearby. The spring 32 then pushed down the first spindle element 31, and the second spindle element 33, under the influence of the pressure of the secondary accumulator 9, followed until it hit a stop 35 fixed to the housing of the spray head. The connection from the inlet of the spray head 26 to its nozzles 34 is then open.

As a result, as earlier described, the valve 3 on the primary hydraulic accumulator 1 will take the state according to FIG. 2, and the pressure of the primary accumulator will act on the inlet to the similar spray heads 27, 28, and 29 (FIG. 3) as well. Then, as shown in FIG. 6, the second spindle element 33 of the spray head 29, for example, will be pushed into abutment against the stop 35 and the connection from the inlet of the spray head 29 to its nozzles 34 becomes open, too. The force of the spring 32 is preferably such that, even in its fully compressed state as shown in FIG. 6, it does not crush the release ampoule 30; the pressure for opening the connection to the nozzles in this way can be set, e.g., to 15 bar in the line 35.

Figure 7:
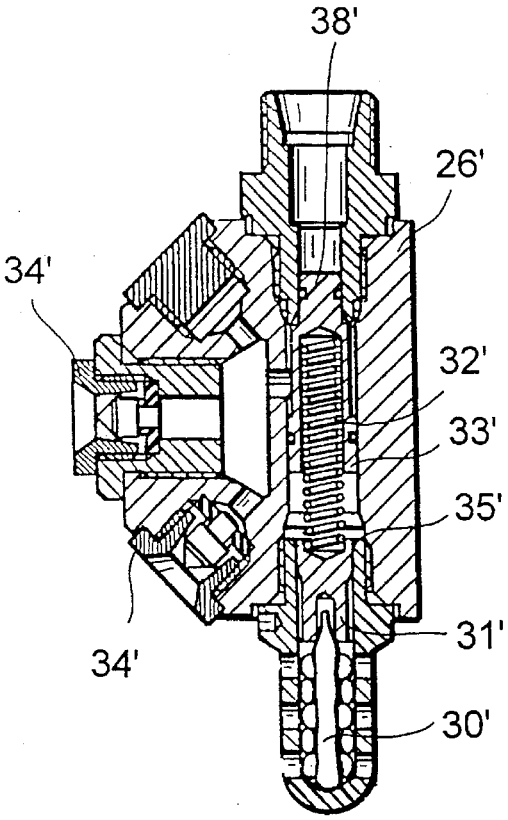
FIGS. 7–9 are cross-sectional elevational views of a second preferred embodiment of spray heads for the installation of FIG. 3 respectively in the same conditions as the spray heads of FIG. 4–6.
Figure 8:
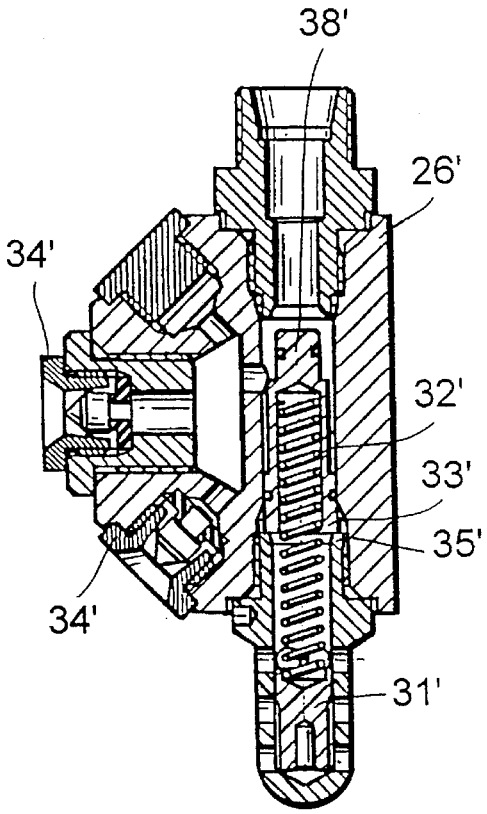
Figure 9:
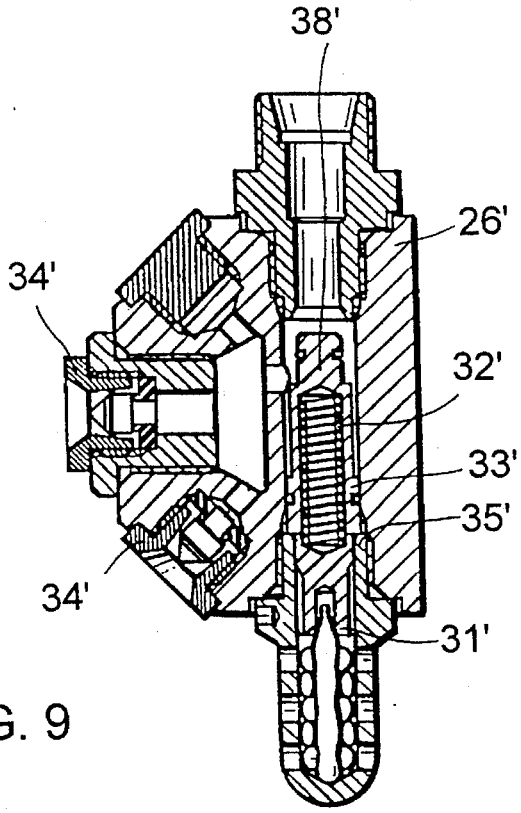

FIGS. 7–9 show an alternative embodiment which can be mounted on a wall and which works according to the same principle as already has been described with reference to FIGS. 4–6. Corresponding but primed reference characters thus designate corresponding components and no further description is required.

The spray heads according FIGS. 4–9 can be of course used independently of valves according to FIGS. 1 and 2, which valves on their part do not presuppose spray heads according to FIGS. 4–9.

For larger installations the invention can of course be applied on an arbitrary number of hydraulic accumulators and/or high pressure pumps. With respect to spray heads, nozzles, group release, and other arrangements, these can also be as described, e.g., in the International Patent Applications PCT/FI92/00060, . . . /00122, . . . /00155, . . . /00156, . . . /00193, . . . /00213, . . . /00316, . . . 00317, and . . . /00330, which are publications WO92/15370, . . . 19324, . . . /20453, . . . /20454, . . . /22353, WO93/00962, . . . /10860, . . . 10859, and . . . /10861, respectively.

I claim:

1. A spray head comprising a housing, an inlet in the housing, nozzles (34) on the housing, a release ampoule (30) in the housing, a spring (32) in the housing, and a spindle element (33) pressed against the inlet of the housing by the spring (32); the spring (32) having such a spring force that the spindle element (33) keeps the inlet closed against a stand-by pressure but yields to high pressure extinguishing liquid for delivering the liquid to the nozzles (34) of the housing while the release ampoule (30) remains intact even when the force of the spring acts on the release ampoule.

2. A spray head comprising a housing, an inlet in the housing, nozzles (34) on the housing, a release ampoule (30) in the housing, a spring (32) in the housing, and a spindle structure pressed against the inlet of the housing by the spring (32); the spring (32) having such a force that the spindle structure keeps the inlet closed against a stand-by pressure but yields to high pressure extinguishing liquid of a high pressure source for delivering the liquid to the nozzles (34) of the housing while the release ampoule (30) remains intact even when the force of the spring acts on the release ampoule, the spindle structure comprising a first spindle element (31) and a second spindle element (33), the release ampoule (30) being engaged by the first spindle element (31) which is pressed upon by a first end of the spring (32), a second end of the spring (32) pressing the second spindle element (33) against the inlet of the housing, the second spindle element (33) being movable inwardly by a pressure larger than the stand-by pressure, inward movement of the second spindle element being limited by hitting a fixed stop (35) in the housing.

3. The spray head according to claim 2, wherein the force of the spring (32) is such that the release ampoule (30) is not crushed when the second spindle element (33) hits the stop (35).

4. A spray head comprising:

a housing;

an inlet opening into the housing for receiving first and second liquids;

at least one nozzle connected to the inlet opening for spraying the liquids from the housing when the inlet opening is open;

one spindle element in the housing having one end in the inlet opening for being acted on by first and second pressures of the first and second liquids received therein and being movable in the housing from a first position in which the one end of the one spindle element closes the inlet opening to a second position in which the one end of the one spindle element opens the inlet opening, the pressures acting on the one end of the one spindle element to urge the one spindle element toward the second position;

a spring in the housing and having one end acting on the one spindle element and urging the one spindle element into the first position for keeping the inlet opening closed under the second pressure but open under the first pressure;

release means in the housing for responding to a fire with movement of the one spindle element from the first position to the second position;

an ampoule in the release means for being crushed or melted by the fire; and another spindle element movably mounted in the housing and having one end engaging the ampoule and an opposite end engaging an opposite end of the spring.

5. The spray head according to claim 4, and further comprising a stop for limiting the second position of the one spindle element, and wherein the ampoule has a strength such that it is not crushed by the spring and the other spindle element when the one spindle element is in the second position.

* * * * *